US010679780B2

(12) United States Patent
Tan et al.

(10) Patent No.: US 10,679,780 B2
(45) Date of Patent: Jun. 9, 2020

(54) COMPOSITE SOFT MAGNETIC MATERIAL AND PREPARATION METHOD FOR SAME

(71) Applicant: Shenzhen Sunlord Electronics Co., Ltd., Shenzhen, Guangdong (CN)

(72) Inventors: Min Tan, Guangdong (CN); Min Nie, Guangdong (CN); Youyun Li, Guangdong (CN)

(73) Assignee: Shenzhen Sunlord Electronics Co., Ltd., Shenzhen, Guangdong ( * ) Notice: Subject to any disclaimer, the term of this patent is extended or adjusted under 35 U.S.C. 154(b) by 290 days.

(21) Appl. No.: 15/865,200

(22) Filed: Jan. 8, 2018

(65) Prior Publication Data

US 2018/0130582 A1 May 10, 2018

Related U.S. Application Data

(63) Continuation of application No. PCT/CN2016/082075, filed on May 13, 2016.

(51) Int. Cl.

| | |
|---|---|
| ***H01F 1/22*** | (2006.01) |
| ***C22C 33/02*** | (2006.01) |
| ***H01F 41/02*** | (2006.01) |
| ***B22F 1/00*** | (2006.01) |
| ***H01F 1/36*** | (2006.01) |
| ***C22C 38/02*** | (2006.01) |
| ***C22C 38/18*** | (2006.01) |
| ***C22C 38/00*** | (2006.01) |

(52) U.S. Cl.

CPC ..... *H01F 1/22* (2013.01); *C22C 33/02* (2013.01); *C22C 38/002* (2013.01); *C22C 38/02* (2013.01); *C22C 38/18* (2013.01); *H01F 1/36* (2013.01); *H01F 41/0246* (2013.01); *B22F 2001/0066* (2013.01); *B22F 2201/02* (2013.01); *B22F 2202/01* (2013.01); *B22F 2998/10* (2013.01); *B22F 2999/00* (2013.01); *C22C 2202/02* (2013.01)

(58) Field of Classification Search

None

See application file for complete search history.

(56) References Cited

U.S. PATENT DOCUMENTS

2005/0072955 A1 4/2005 Takahashi
2009/0191421 A1* 7/2009 Huang ..... C22C 33/0278 428/570

(Continued)

FOREIGN PATENT DOCUMENTS

CN 102360663 A 2/2012
CN 104392819 A 3/2015

(Continued)

*Primary Examiner* — Colleen P Dunn
*Assistant Examiner* — Michael J Kachmarik
(74) *Attorney, Agent, or Firm* — Winston Hsu

(57) ABSTRACT

A composite soft magnetic material includes the following components: 67.9 to 95.54 wt % of FeSiCr, 0.1 to 0.3 wt % of $TiO_2$, 0.15 to 0.75 wt % of $SiO_2$, 0.1 to 0.5 wt % of $Mn_3O_4$, 0.1 to 0.5 wt % of ZnO, 3.4 to 25.9 wt % of BaO, 0.4 to 3 wt % of $B_2O_3$, 0.2 to 0.85 wt % of CaO, and 0.01 to 0.3 wt % of CuO. The composite soft magnetic material has high initial permeability and high Bs, excellent temperature stability, and low temperature coefficient.

11 Claims, 1 Drawing Sheet

(56) References Cited

U.S. PATENT DOCUMENTS

| | | | | |
|---|---|---|---|---|
| 2011/0272622 | A1* | 11/2011 | Wakabayashi | C21D 6/008 252/62.55 |
| 2012/0001719 | A1* | 1/2012 | Oshima | H01F 1/26 336/233 |
| 2012/0326830 | A1* | 12/2012 | Oshima | H01F 1/26 336/221 |
| 2017/0053729 | A1* | 2/2017 | Kotani | H01F 1/14733 |

FOREIGN PATENT DOCUMENTS

| | | | |
|---|---|---|---|
| CN | 104392820 | A | 3/2015 |
| CN | 104409189 | A | 3/2015 |
| CN | 105110782 | A | 12/2015 |

* cited by examiner

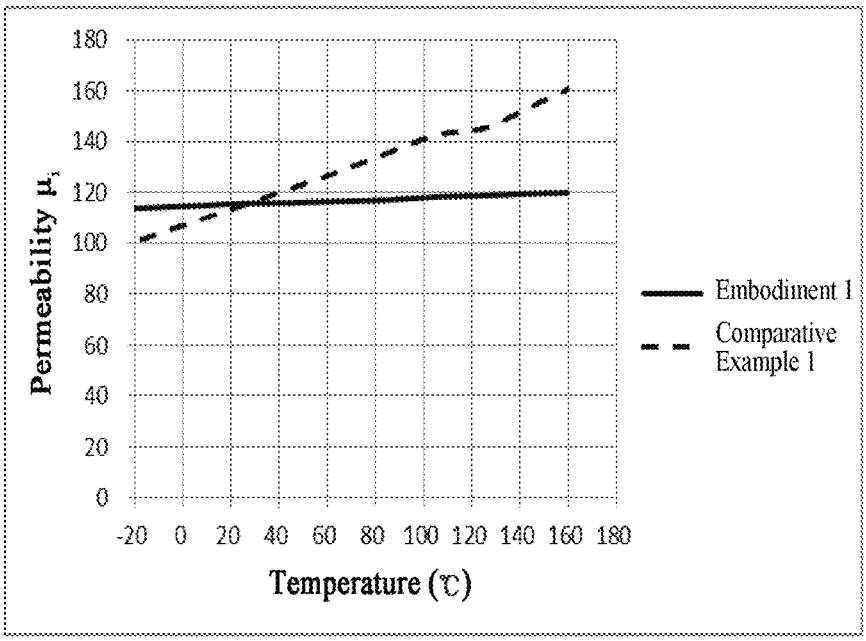
180
160
140
120
100
80
60
40
20
0
Permeability $\mu_i$
-20 0 20 40 60 80 100 120 140 160 180
Temperature (℃)
Embodiment 1
Comparative Example 1

COMPOSITE SOFT MAGNETIC MATERIAL AND PREPARATION METHOD FOR SAME

CROSS REFERENCE TO RELATED APPLICATIONS

This application is a continuation application of PCT/CN2016/082075, filed on 2016 May 13. The contents of the above-mentioned applications are all hereby incorporated by reference.

BACKGROUND OF THE INVENTION

1. Field of the Invention

The present invention relates to the field of soft magnetic materials, and particularly, to a composite soft magnetic material and a preparation method for same.

2. Description of the Related Art

Soft magnetic alloy has the most obvious advantages of high saturation magnetic flux density (Bs), good temperature stability, low temperature coefficient, and good DC superposition characteristic, while soft magnetic ferrite has the most obvious advantages of high initial permeability and resistivity ($10^2$ to $10^6$ Ω·cm).

With the development of electric vehicles, the automotive electronic components develop towards miniaturization and high-current, and application in a large temperature range, and therefore higher requirements are imposed on the performance of soft magnetic materials. Power inductors are generally used at a frequency of 100 KHz or higher. On one hand, a core of the soft magnetic alloy is prone to generate relatively much heat due to low resistivity, low insulation and voltage withstanding performance, and much loss at high frequency, causing deterioration of device performance. On the other hand, the relatively high temperature coefficient of the soft magnetic ferrite causes a large change in the permeability of a device as the temperature changes, resulting in instable performance of the device at a low or high temperature. In addition, the soft magnetic alloy powder core generally has a low permeability. In order to obtain a relatively high inductance, a device often needs to have an increased number of coils, resulting in increased copper loss, and deteriorated performance of the device. Therefore, it is necessary to increase the initial permeability of the material. In order to meet the requirements of miniaturization and high-current and application in a large temperature range of power inductors for use in automotive electronics, it is necessary to develop a composite soft magnetic material with a high magnetic permeability, high Bs and excellent temperature stability.

Some patents concerning the methods for preparing composite soft magnetic materials are disclosed, specifically as follows.

(1) Chinese Patent Publication No. CN201410214573.4, disclosed on Mar. 4, 2015 and entitled "Composite soft magnetic material and preparation method for same" discloses a composite soft magnetic material and a preparation method for same. The composite soft magnetic material includes the following components, in percentage by weight: 82.56 to 98.45 wt % of FeSiCr, 0.3 to 8.9 wt % of $Fe_2O_3$, 0.1 to 1.93 wt % of NiO, 0.1 to 2.13 wt % of ZnO, and 0.1 to 0.53 wt % of CuO. The method for preparing a composite soft magnetic material includes mixing, pre-sintering, grinding, pressing, and sintering. In the present invention, the saturation magnetic flux density of the composite soft magnetic material is adjusted by adjusting the FeSiCr content, and the content of generated NiCuZn ferrite is adjusted by adjusting the content of $Fe_2O_3$, NiO, ZnO, and CuO, thereby improving the insulation and voltage withstanding performance of the composite soft magnetic material.

(2) Chinese Patent Publication No. CN201410214841.2, disclosed on Mar. 4, 2015 and entitled "Composite soft magnetic material and preparation method for same" discloses a composite soft magnetic material and a preparation method for same. The composite soft magnetic material includes the following components, in percentage by weight: 75.13 to 86.12 wt % of FeSiCr alloy powder, 9 to 14.5 wt % of $Fe_2O_3$, 1.95 to 2.99 wt % of NiO, 2.15 to 3.75 wt % of ZnO, 0.55 to 1.43 wt % of CuO, 0.03 to 0.85 wt % of $Bi_2O_3$, 0.15 to 0.45 wt % of $V_2O_5$, and 0.05 to 0.9 wt % of $SiO_2$. During preparation, materials of the above formulation ratio are mixed, pre-sintered, ground, granulated, pressed, and sintered to prepare the composite soft magnetic material. In the composite soft magnetic material and preparation method for same provided in the present invention, components of specific content are utilized, and a composite soft magnetic material with high insulation, voltage withstanding performance and high Bs is prepared by adjustment of the content of various materials or addition of some components in combination with a production process.

(3) Chinese Patent Publication No. CN201410214819.8, disclosed on Mar. 11, 2015 and entitled "Composite soft magnetic material and preparation method for same" discloses a composite soft magnetic material and a preparation method for same. The composite soft magnetic material includes the following components by weight: 48.25 to 76.91 wt % of FeSiCr, 15 to 30.5 wt % of $Fe_2O_3$, 3 to 9 wt % of NiO, 3.8 to 7.3 wt % of ZnO, 1.0 to 2.5 wt % of CuO, 0.01 to 0.65 wt % of $Bi_2O_3$, 0.03 to 0.55 wt % of $V_2O_5$, 0.15 to 0.75 wt % of $SiO_2$, and 0.1 to 0.5 wt % of $Mn_3O_4$. The composite soft magnetic material has high initial permeability and high Bs.

(4) Chinese Patent Publication No. CN201110152217.0, disclosed on Feb. 22, 2012 and entitled "Composite soft magnetic material and preparation method for same" discloses a composite soft magnetic material having high density and high magnetic flux density and a preparation method for same. The composite soft magnetic material consists of an atomized iron-based powder, a lubricant, and a metal adhesion promoter, where the amount of the lubricant is 0.01 to 2% by weight of the atomized iron-based powder, the amount of the metal adhesion promoter is 0.01 to 2% by weight of the atomized iron-based powder, and the metal adhesion promoter and the lubricant are evenly coated onto the surface of the atomized iron-based powder. The lubricant is nano-activated calcium carbonate and/or nano-alumina, and the metal adhesion promoter is a titanate ester. The preparation process of the present invention has the advantages of simple preparation process, low material costs, high density and high magnetic flux density.

SUMMARY OF THE INVENTION

To overcome disadvantages existing in the prior art, the present disclosure provides a composite soft magnetic material and a preparation method for same, so as to obtain a composite soft magnetic material having high initial permeability, high Bs, and excellent temperature stability.

The composite soft magnetic material includes the following components, in percentage by weight:

67.9 to 95.54 wt % of FeSiCr, 0.1 to 0.3 wt % of $TiO_2$, 0.15 to 0.75 wt % of $SiO_2$, 0.1 to 0.5 wt % of $Mn_3O_4$, 0.1 to 0.5 wt % of ZnO, 3.4 to 25.9 wt % of BaO, 0.4 to 3 wt % of $B_2O_3$, 0.2 to 0.85 wt % of CaO, and 0.01 to 0.3 wt % of CuO, where the composite soft magnetic material does not comprise $Fe_2O_3$.

Further, FeSiCr is a powder having an average particle size of 5 to 100 μm.

Further, $TiO_2$, $SiO_2$, $Mn_3O_4$, ZnO, BaO, $B_2O_3$, CaO and CuO have an average particle size of 50 to 100 nm.

Further, FeSiCr, $TiO_2$, $SiO_2$, $Mn_3O_4$, ZnO, BaO, $B_2O_3$, CaO and CuO respectively account for 90.1 wt %, 0.17 wt %, 0.3 wt %, 0.45 wt %, 0.3 wt %, 7.41 wt %, 0.92 wt %, 0.26 wt %, and 0.09 wt % of the composite soft magnetic material.

The method for preparing a composite soft magnetic material includes:

a mixing step, in which FeSiCr, $TiO_2$, $SiO_2$, $Mn_3O_4$ and ZnO are dry mixed, to obtain a mixture;

a pre-pressing step, in which the mixture is pressed by a powder molding machine, to prepare a mixture blank;

a pre-sintering step, in which the mixture is pre-sintered under a nitrogen atmosphere, to obtain a pre-sintered material;

a grinding step, in which BaO, $B_2O_3$, CaO, and CuO are mixed with the pre-sintered material and then wet ground in a solvent, to obtain a ground slurry;

a granulation step, in which the ground slurry is added with a binder, ultrasonically dispersed, and granulated, to obtain a granular material;

a pressing step, in which the granular material is pressed by a powder molding machine, to obtain a blank; and a sintering step, in which the blank is sintered, to obtain the composite soft magnetic material, where addition amount of FeSiCr, $TiO_2$, $SiO_2$, $Mn_3O_4$, ZnO, BaO, $B_2O_3$, CaO, and CuO is, in percentage by weight:

67.9 to 95.54 wt % of FeSiCr, 0.1 to 0.3 wt % of $TiO_2$, 0.15 to 0.75 wt % of $SiO_2$, 0.1 to 0.5 wt % of $Mn_3O_4$, 0.1 to 0.5 wt % of ZnO, 3.4 to 25.9 wt % of BaO, 0.4 to 3 wt % of $B_2O_3$, 0.2 to 0.85 wt % of CaO, and 0.01 to 0.3 wt % of CuO.

Further, the addition amount of FeSiCr, $TiO_2$, $SiO_2$, $Mn_3O_4$, ZnO, BaO, $B_2O_3$, CaO, and CuO is, in percentage by weight:

90.1 wt % of FeSiCr, 0.17 wt % of $TiO_2$, 0.3 wt % of $SiO_2$, 0.45 wt % of $Mn_3O_4$, 0.3 wt % of ZnO, 7.41 wt % of BaO, 0.92 wt % of $B_2O_3$, 0.26 wt % of CaO, and 0.09 wt % of CuO.

Further, the solvent is anhydrous ethanol.

Further, the binder is polyacrylamide.

Further, the method meets one or more of the following process conditions:

a) in the mixing step, a mixing time is 30 to 70 min;

b) in the pre-pressing step, a pre-pressing pressure is 5 tons/$cm^2$;

c) in the pre-sintering step, a pre-sintering temperature is controlled at 750±20° C., a pre-sintering time is 100 to 200 min, and oxygen content is controlled below 1%;

d) in the grinding step, a grinding time is 120 to 240 min, and a particle size of the slurry after grinding is controlled in a range of 1.5 to 35 μm;

e) in the granulation step, the polyacrylamide is 2 to 6% by weight of the ground slurry;

f) in the pressing step, a pressed density of the blank is controlled to be (5.80±0.10) g/$cm^3$; and g) in the sintering step, a sintering temperature is controlled in a range of 920° C. to 960° C., and maintained for 200 to 300 min, a sintering atmosphere is nitrogen, and oxygen content is controlled below 1%.

Further, FeSiCr is a power having an average particle size of 5 to 100 μm, and $TiO_2$, $SiO_2$, $Mn_3O_4$, ZnO, BaO, $B_2O_3$, CaO and CuO have an average particle size of 50 to 100 nm.

The present disclosure has the following beneficial effects.

In the present disclosure, a proper main composition is adopted. The saturation magnetic flux density of the material is adjusted by setting the content of the FeSiCr powder; the insulation and voltage withstanding performance of the material is improved by increasing the content of nano-$SiO_2$; the permeability of the material is enhanced by adding nano-$Mn_3O_4$ and nano-ZnO; the temperature coefficient of the material is adjusted by adding nano-$TiO_2$; and the content of the generated low-melting-point phase is adjusted by setting the content of nano-BaO, $B_2O_3$, CaO, and CuO, thereby increasing the permeability and further improving the insulation and voltage withstanding performance of the material; and the distribution of crystallization is further adjusted through the production process, thereby obtaining a relatively high permeability and Bs, and ensuring proper insulation and voltage withstanding performance. The material has the characteristics of high permeability and high Bs, so as to meet the requirements for soft magnetic materials in miniaturization and high-current application of power inductors.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIGURE is a curve chart showing pi-temperature relationships of an embodiment of the present disclosure and a comparative example.

DETAILED DESCRIPTION

Exemplary embodiments of the present disclosure are further described in detail below.

A composite soft magnetic material includes the following components:

67.9 to 95.54 wt % of FeSiCr, 0.1 to 0.3 wt % of $TiO_2$, 0.15 to 0.75 wt % of $SiO_2$, 0.1 to 0.5 wt % of $Mn_3O_4$, 0.1 to 0.5 wt % of ZnO, 3.4 to 25.9 wt % of BaO, 0.4 to 3 wt % of $B_2O_3$, 0.2 to 0.85 wt % of CaO, and 0.01 to 0.3 wt % of CuO.

In some embodiments, FeSiCr is a powder having an average particle size of 5 to 100 μm.

In some embodiments, $TiO_2$, $SiO_2$, $Mn_3O_4$, ZnO, BaO, $B_2O_3$, CaO and CuO have an average particle size of 50 to 100 nm.

In a particularly preferable embodiment, FeSiCr, $TiO_2$, $SiO_2$, $Mn_3O_4$, ZnO, BaO, $B_2O_3$, CaO and CuO respectively account for 90.1 wt %, 0.17 wt %, 0.3 wt %, 0.45 wt %, 0.3 wt %, 7.41 wt %, 0.92 wt %, 0.26 wt %, and 0.09 wt % of the composite soft magnetic material.

A method for preparing a composite soft magnetic material includes:

a mixing step, in which 90.1 wt % of FeSiCr, 0.17 wt % of $TiO_2$, 0.3 wt % of $SiO_2$, 0.45 wt % of $Mn_3O_4$ and 0.3 wt % of ZnO are dry mixed;

a pre-pressing step, in which the mixture is pressed by a powder molding machine, to prepare a mixture blank;

a pre-sintering step, in which the mixture is pre-sintered under a nitrogen atmosphere, to obtain a pre-sintered material;

a grinding step, in which 7.41 wt % of BaO, 0.92 wt % of $B_2O_3$, 0.26 wt % of CaO, and 0.09 wt % of CuO are mixed with the pre-sintered material and then wet ground in a solvent, to obtain a ground slurry, where the solvent is preferably anhydrous ethanol;

a granulation step, in which the ground slurry is added with a binder that is preferably polyacrylamide, ultrasonically dispersed, and granulated, to obtain a granular material;

a pressing step, in which the granular material is pressed by a powder molding machine, to obtain a blank; and a sintering step, in which the blank is sintered under a nitrogen atmosphere, and then cooled to a room temperature with the furnace after sintering.

In the mixing step, dry mixing is applied to facilitate the pre-sintering step. By contrast, the pre-sintering step is prolonged if wet mixing is employed. The pre-sintering step is further shortened by performing the pre-pressing step. In the grinding step, wet mixing facilitates the subsequent granulation step. Ultrasonic dispersion before granulation is conducive to the more evenly coating of an adhesive on the surface of the powder particles, so as to granulate better.

In some embodiments, in the mixing step, a mixing time is 30 to 70 min.

In some embodiments, in the pre-sintering step, a pre-sintering temperature is controlled to be 750±20° C., a pre-sintering time is 100 to 200 min, and oxygen content is controlled below 1%.

In some embodiments, in the grinding step, a grinding time is 120 to 240 min, and a particle size of the slurry after grinding is controlled in a range of 1.5 to 35 μm.

In some embodiments, in the granulation step, the polyacrylamide is 2 to 6% and preferably 4.5% by weight of the ground slurry.

In some embodiments, in the pressing step, a pressed density of the blank is controlled to be (5.80±0.10) g/cm$^3$.

In some embodiments, in the sintering step, a sintering temperature is controlled in a range of 920 to 960° C., and maintained for 200 to 300 min, a sintering atmosphere is nitrogen, and oxygen content is controlled below 1%.

In the present disclosure, a proper main composition is adopted, in which the saturation magnetic flux density of the material is adjusted by adjusting the content of the FeSiCr powder; the insulation and voltage withstanding performance of the material is improved by increasing the content of nano-$SiO_2$; the permeability of the material is enhanced by adding nano-$Mn_3O_4$ and nano-ZnO; the temperature coefficient of the material is adjusted by adding nano-$TiO_2$; and the content of the generated low-melting-point phase is adjusted by adjusting the content of nano-BaO, $B_2O_3$, CaO, and CuO, thereby increasing the permeability and further improving the insulation and voltage withstanding performance of the material; and the distribution of crystallization is further adjusted through the production process, thereby obtaining a high permeability and Bs, and ensuring proper insulation and voltage withstanding performance. The material has the characteristics of high permeability and high Bs, so as to meet the requirements for soft magnetic materials in miniaturization and high-current application of power inductors.

The material has the following performance indicators:

(1) initial permeability $\mu_i$: 115 (1±20%);

(2) saturation magnetic flux density Bs: ≥1000 mT;

(3) insulation resistance: ≥50 MΩ;

(4) voltage tolerance: ≥50 V; and temperature coefficient $\alpha\mu i\gamma$ ($10^{-6}$/° C.): −10 to 10.

In some specific embodiment, the method for preparing a composite soft magnetic material includes:

(1) mixing, in which initial ingredients as shown in Table 1 (embodiments and comparative examples) are dry mixed for 30 to 70 min;

(2) pre-pressing, in which the mixed power is pre-pressed into a block by a powder molding machine under a pressure of 5 tons/cm$^2$;

(3) pre-sintering, in which the blocky material is pre-sintered under a nitrogen atmosphere in a pusher kiln, where a pre-sintering temperature is controlled to be 550±20° C., a pre-sintering time is 100 to 200 min, and oxygen content is controlled below 1%;

(4) grinding, in which the pre-sintered material obtained after the pre-sintering step is added with ingredients added for grinding and then wet ground in anhydrous ethanol as a solvent, where a grinding time is 120 to 240 min, and a particle size of the slurry after grinding is controlled in a range of 1.5 to 35 μm;

(5) granulation, in which polyacrylamide of 4.5% by weight of the slurry is added to the slurry obtained above, ultrasonically dispersed, and granulated, to obtain a granular material;

(6) pressing, in which the granular material obtained above is pressed into a blank by using a powder molding machine, where the pressed density of the blank is controlled to be (5.80±0.10) g/cm$^3$; and (7) sintering, in which the blank is sintered under a nitrogen atmosphere in a resistance furnace, where a sintering temperature is controlled in a range of 920 to 960° C. and maintained for 200 to 300 min, a sintering atmosphere is nitrogen, and oxygen content is controlled below 1%; and the resulting material is cooled to a room temperature after sintering.

Magnetic ring samples (herein a magnetic ring size is T8×5×2) of the composite material are fabricated through the above process.

The composite magnetic rings after sintering are tested and evaluated separately. With the number of turns is N=26 Ts, the initial permeability $\mu_i$ of the magnetic ring sample is tested by using an HP-4284 LCR meter; the saturation magnetic flux density Bs of the sample is tested by using an SY-8218 B-H analyzer; insulation and voltage withstanding performance of the sample is tested by using a CH-333 dielectric withstanding voltage tester; and the temperature characteristic of the magnetic ring sample is tested by using a WKS3-270/70/20 rapid temperature change box and a ZM2371 LCR meter.

TABLE 1

Initial ingredients and formulation ratio in embodiments and comparative examples

| | Ingredient, wt % | | | | | | | | | | |
|---|---|---|---|---|---|---|---|---|---|---|---|
| | Initial ingredients | | | | | | | Ingredients added for grinding | | | |
| | FeSiCr | $TiO_2$ | $SiO_2$ | $Mn_3O_4$ | ZnO | $Fe_2O_3$ | NiO | BaO | $B_2O_3$ | CaO | CuO |
| Example 1 | 90.1 | 0.17 | 0.3 | 0.45 | 0.3 | / | / | 7.41 | 0.92 | 0.26 | 0.09 |
| Example 2 | 90.1 | 0.17 | 0.3 | 0.4 | 0.3 | / | / | 7.41 | 0.94 | 0.29 | 0.09 |
| Example 3 | 90.1 | 0.17 | 0.3 | 0.35 | 0.3 | / | / | 7.41 | 0.97 | 0.31 | 0.09 |
| Example 4 | 90.1 | 0.17 | 0.3 | 0.5 | 0.3 | / | / | 7.41 | 0.89 | 0.24 | 0.09 |
| Example 5 | 90.1 | 0.17 | 0.3 | 0.55 | 0.3 | / | / | 7.41 | 0.85 | 0.23 | 0.09 |
| Comparative example 1 | / | / | 0.3 | / | 16.88 | 67.8 | 12.03 | / | / | / | 2.99 |
| Comparative example 2 | 90.1 | 0.17 | 0.65 | 0 | 0.3 | / | / | 7.15 | 0.95 | 0.28 | 0.09 |
| Comparative example 3 | 90.1 | 0.17 | 0.3 | 0.9 | 0.3 | / | / | 7.21 | 0.75 | 0.18 | 0.09 |
| Comparative example 4 | 90.1 | 0.17 | 0.3 | 1.0 | 0.3 | / | / | 7.12 | 0.75 | 0.17 | 0.09 |
| Comparative example 5 | 90.1 | 0.17 | 0.3 | 1.1 | 0.3 | / | / | 7.09 | 0.7 | 0.15 | 0.09 |

TABLE 2

Performance and evaluation of embodiments and comparative examples

| Item | $\mu_i$ | Bs 25° C. | Insulation resistance | Withstanding voltage | $\alpha\mu i\gamma$ 20° C.-125° C. | Evaluation |
|---|---|---|---|---|---|---|
| Unit | — | mT | MΩ | V | $\times 10^{-6}$ | — |
| Indicator | 115 (1 ± 20%) | ≥1000 | ≥50 | ≥50 | −10-10 | — |
| Example 1 | 115 | 1184 | 178 | 187 | 7 | OK |
| Example 2 | 101 | 1203 | 174 | 189 | 5 | OK |
| Example 3 | 106 | 1209 | 171 | 177 | 3 | OK |
| Example 4 | 97 | 1173 | 173 | 174 | 5 | OK |
| Example 5 | 94 | 1168 | 170 | 168 | 4 | OK |
| Comparative example 1 | 115 | *430 | 235 | 200 | *45 | NG |
| Comparative example 2 | *88 | 1110 | 169 | 171 | 3 | NG |
| Comparative example 3 | *84 | 1066 | 167 | 173 | 3 | NG |
| Comparative example 4 | *77 | 1063 | 159 | 175 | 3 | NG |
| Comparative example 5 | *69 | 1054 | 155 | 167 | 3 | NG |

Note:
*is affixed where the index exceeds the specification.

Table 2 shows the performance and evaluation of the embodiments and comparative examples. It can be seen from Table 2 that in the embodiments of the present invention, the initial permeability of the material is effectively improved, and corresponding insulation and voltage withstanding performance, relatively high saturation magnetic flux density, and nearly-zero temperature coefficient are maintained. In the present invention, the initial permeability can be up to 115 (1±20%). As shown in the table, the Bs in Embodiment 1 is obviously better than that in Comparative example 1, and the temperature coefficient $\alpha\mu i\gamma$ in Embodiment 1 is obviously better than that in Comparative example 1. As can be seen from $\mu_i$-temperature curves (in FIGURE) of an embodiment and a comparative example, the characteristic of temperature stability of the embodiment is obviously better than that of the comparative example. The present material has a relatively high Bs that usually corresponds to a relatively high saturation current, a nearly-zero temperature coefficient $\alpha\mu i\gamma$ that allows a wider application range where the material can work, and a frequency characteristic that is substantially the same as a corresponding ferrite material. The material of the present invention can meet the requirements for soft magnetic materials in miniaturization and high-current and application in a large temperature range of power inductors for use in automotive electronics.

Although the present disclosure is described above in further detail through specific embodiments, the present invention is not limited to the specific embodiments. It should be understood by persons of ordinary skill in the art that any simple deduction or replacement made without departing from the spirit of the present invention shall fall within the protection scope specified by the claims provided in the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for preparing a composite soft magnetic material, comprising:

a mixing step, in which FeSiCr, $TiO_2$, $SiO_2$, $Mn_3O_4$ and ZnO are dry mixed, to obtain a mixture;

a pre-pressing step, in which the mixture is pressed by a powder molding machine, to prepare a mixture blank;

a pre-sintering step, in which the mixture is pre-sintered under a nitrogen atmosphere, to obtain a pre-sintered material;

a grinding step, in which BaO, $B_2O_3$, CaO, and CuO are mixed with the pre-sintered material and then wet ground in a solvent, to obtain a ground slurry;

a granulation step, in which the ground slurry is added with a binder, ultrasonically dispersed, and granulated, to obtain a granular material;

a pressing step, in which the granular material is pressed by a powder molding machine, to obtain a blank; and a sintering step, in which the blank is sintered, to obtain the composite soft magnetic material, wherein addition amount of FeSiCr, $TiO_2$, $SiO_2$, $Mn_3O_4$, ZnO, BaO, $B_2O_3$, CaO, and CuO is, in percentage by weight:

67.9 to 95.54 wt % of FeSiCr, 0.1 to 0.3 wt % of $TiO_2$, 0.15 to 0.75 wt % of $SiO_2$, 0.1 to 0.5 wt % of $Mn_3O_4$, 0.1 to 0.5 wt % of ZnO, 3.4 to 25.9 wt % of BaO, 0.4 to 3 wt % of $B_2O_3$, 0.2 to 0.85 wt % of CaO, and 0.01 to 0.3 wt % of CuO.

2. The method for preparing a composite soft magnetic material according to claim 1, wherein the addition amount of the FeSiCr, $TiO_2$, $SiO_2$, $Mn_3O_4$, ZnO, BaO, $B_2O_3$, CaO, and CuO is, in percentage by weight:

90.1 wt % of FeSiCr, 0.17 wt % of $TiO_2$, 0.3 wt % of $SiO_2$, 0.45 wt % of $Mn_3O_4$, 0.3 wt % of ZnO, 7.41 wt % of BaO, 0.92 wt % of $B_2O_3$, 0.26 wt % of CaO, and 0.09 wt % of CuO.

3. The method for preparing a composite soft magnetic material according to claim 1, wherein the solvent is anhydrous ethanol.

4. The method for preparing a composite soft magnetic material according to claim 1, wherein the binder is polyacrylamide.

5. The method for preparing a composite soft magnetic material according to claim 1, wherein one or more of the following process conditions is/are met:

a) in the mixing step, a mixing time is 30 to 70 min;

b) in the pre-pressing step, a pre-pressing pressure is 5 tons/$cm^2$;

c) in the pre-sintering step, a pre-sintering temperature is controlled to be 750±20° C., a pre-sintering time is 100 to 200 min, and oxygen content is controlled below 1%;

d) in the grinding step, a grinding time is 120 to 240 min, and a particle size of the slurry after grinding is controlled in a range of 1.5 to 35 μm;

e) in the granulation step, the binder is 2 to 6% by weight of the ground slurry;

f) in the pressing step, a pressed density of the blank is controlled to be (5.80±0.10) g/$cm^3$; and g) in the sintering step, a sintering temperature is controlled in a range of 920° C. to 960° C., and maintained for 200 to 300 min, a sintering atmosphere is nitrogen, and oxygen content is controlled below 1%.

6. The method for preparing a composite soft magnetic material according to claim 2, wherein one or more of the following process conditions is/are met:

a) in the mixing step, a mixing time is 30 to 70 min;

b) in the pre-pressing step, a pre-pressing pressure is 5 tons/$cm^2$;

c) in the pre-sintering step, a pre-sintering temperature is controlled to be 750±20° C., a pre-sintering time is 100 to 200 min, and oxygen content is controlled below 1%;

d) in the grinding step, a grinding time is 120 to 240 min, and a particle size of the slurry after grinding is controlled in a range of 1.5 to 35 μm;

e) in the granulation step, the binder is 2 to 6% by weight of the ground slurry;

f) in the pressing step, a pressed density of the blank is controlled to be (5.80±0.10) g/$cm^3$; and g) in the sintering step, a sintering temperature is controlled in a range of 920° C. to 960° C., and maintained for 200 to 300 min, a sintering atmosphere is nitrogen, and oxygen content is controlled below 1%.

7. The method for preparing a composite soft magnetic material according to claim 3, wherein one or more of the following process conditions is/are met:

a) in the mixing step, a mixing time is 30 to 70 min;

b) in the pre-pressing step, a pre-pressing pressure is 5 tons/$cm^2$;

c) in the pre-sintering step, a pre-sintering temperature is controlled to be 750±20° C., a pre-sintering time is 100 to 200 min, and oxygen content is controlled below 1%;

d) in the grinding step, a grinding time is 120 to 240 min, and a particle size of the slurry after grinding is controlled in a range of 1.5 to 35 μm;

e) in the granulation step, the binder is 2 to 6% by weight of the ground slurry;

f) in the pressing step, a pressed density of the blank is controlled to be (5.80±0.10) g/$cm^3$; and g) in the sintering step, a sintering temperature is controlled in a range of 920° C. to 960° C., and maintained for 200 to 300 min, a sintering atmosphere is nitrogen, and oxygen content is controlled below 1%.

8. The method for preparing a composite soft magnetic material according to claim 4, wherein one or more of the following process conditions is/are met:

a) in the mixing step, a mixing time is 30-70 min;

b) in the pre-pressing step, a pre-pressing pressure is 5 tons/$cm^2$;

c) in the pre-sintering step, a pre-sintering temperature is controlled to be 750±20° C., a pre-sintering time is 100 to 200 min, and oxygen content is controlled below 1%;

d) in the grinding step, a grinding time is 120 to 240 min, and a particle size of the slurry after grinding is controlled in a range of 1.5 to 35 μm;

e) in the granulation step, the binder is 2 to 6% by weight of the ground slurry;

f) in the pressing step, a pressed density of the blank is controlled to be (5.80±0.10) g/$cm^3$; and g) in the sintering step, a sintering temperature is controlled in a range of 920° C. to 960° C., and maintained for 200 to 300 min, a sintering atmosphere is nitrogen, and oxygen content is controlled below 1%.

9. The method for preparing a composite soft magnetic material according to claim 1, wherein FeSiCr is a power having an average particle size of 5 to 100 μm, and $TiO_2$, $SiO_2$, $Mn_3O_4$, ZnO, BaO, $B_2O_3$, CaO and CuO have an average particle size of 50 to 100 nm.

10. The method for preparing a composite soft magnetic material according to claim 2, wherein FeSiCr is a power having an average particle size of 5 to 100 μm, and $TiO_2$, $SiO_2$, $Mn_3O_4$, ZnO, BaO, $B_2O_3$, CaO and CuO have an average particle size of 50 to 100 nm.

11. The method for preparing a composite soft magnetic material according to claim 5, wherein FeSiCr is a power having an average particle size of 5 to 100 μm, and $TiO_2$, $SiO_2$, $Mn_3O_4$, ZnO, BaO, $B_2O_3$, CaO and CuO have an average particle size of 50 to 100 nm.

* * * * *